US011775001B2

(12) United States Patent
Panja et al.

(10) Patent No.: US 11,775,001 B2
(45) **Date of Patent: *Oct. 3, 2023**

(54) SUB-BANDGAP COMPENSATED REFERENCE VOLTAGE GENERATION CIRCUIT

(71) Applicant: STMicroelectronics International N.V., Shiphol (NL)

(72) Inventors: Pijush Kanti Panja, West Bengal (IN); Gautam Dey Kanungo, Delhi (IN)

(73) Assignee: STMicroelectronics International N.V., Shiphol (NL)

( * ) Notice: Subject to any disclaimer, the term of this patent is extended or adjusted under 35 U.S.C. 154(b) by 156 days.

This patent is subject to a terminal disclaimer.

(21) Appl. No.: 17/467,985

(22) Filed: Sep. 7, 2021

(65) Prior Publication Data

US 2021/0405677 A1 Dec. 30, 2021

Related U.S. Application Data

(63) Continuation of application No. 16/558,717, filed on Sep. 3, 2019, now Pat. No. 11,137,788.

(Continued)

(51) Int. Cl.
*G05F 3/26* (2006.01)

(52) U.S. Cl.
CPC ..... *G05F 3/267* (2013.01)

(58) Field of Classification Search
CPC ..... G05F 3/10; G05F 3/16; G05F 3/18; G05F 3/185; G05F 3/20; G05F 3/26; G05F 3/30;

(Continued)

(56) References Cited

U.S. PATENT DOCUMENTS 8,816,756 B1 8/2014 Eberlein
10,496,122 B1 * 12/2019 Gottapu ..... G05F 3/30

(Continued)

FOREIGN PATENT DOCUMENTS

CN 101414197 A 4/2009
CN 102789254 A 11/2012

(Continued)

OTHER PUBLICATIONS

First Office Action and Search Report for co-pending CN Appl. No. 201910834152.4 dated Mar. 15, 2021 (10 pages).

(Continued)

*Primary Examiner* — Jeffrey A Gblende
(74) *Attorney, Agent, or Firm* — CROWE & DUNLEVY

(57) ABSTRACT

A reference current generator circuit generating a reference current that is proportional to absolute temperature as a function of a difference between bias voltages of first and second transistors. A voltage generator generates an input voltage from the reference current by applying the reference current that is proportional to absolute temperature through a plurality of transistors coupled in series between the bias voltage of the second transistor and ground, with the input voltage being generated at a node between given adjacent ones of the plurality of transistors. The input voltage is complementary to absolute temperature. A differential amplifier is biased by a current derived from the reference current and generates a temperature insensitive output reference voltage from the input voltage and a voltage proportional to absolute temperature.

23 Claims, 2 Drawing Sheets

Related U.S. Application Data

(60) Provisional application No. 62/726,564, filed on Sep. 4, 2018.

(58) Field of Classification Search
CPC ... G05F 3/205; G05F 3/22; G05F 3/24; G05F 3/222; G05F 3/242; G05F 3/225; G05F 3/227; G05F 3/245; G05F 3/247; G05F 3/262; G05F 3/265; G05F 3/267; G05F 1/463; G05F 1/468; G05F 1/46; G05F 1/461; G05F 1/575
See application file for complete search history.

(56) References Cited

U.S. PATENT DOCUMENTS

| | | | |
|---|---|---|---|
| 2009/0160537 | A1 | 6/2009 | Marinca |
| 2009/0243713 | A1 | 10/2009 | Marinca |
| 2010/0201406 | A1 | 8/2010 | Illegems |
| 2017/0139435 | A1* | 5/2017 | Arnold ..... G05F 3/16 |
| 2019/0113946 | A1 | 4/2019 | Nicollini et al. |

FOREIGN PATENT DOCUMENTS

| | | | |
|---|---|---|---|
| CN | 106774592 | A | 5/2017 |
| CN | 107608444 | A | 1/2018 |
| CN | 210691139 | U | 6/2020 |

OTHER PUBLICATIONS

Lee, Chu-Liang et al: "A Low Power Bandgap Voltage Reference for Low-Dropout Regulator," 2015 IEEE (4 pages).

Nararro, Joao and Ishibe, Eder: "A Simple CMOS Bandgap Reference Circuit with Sub-1-V Operation," 2011 IEEE, pp. 2289-2292.

Sun, Na and Sobot, Robert: "A Low-Power Low-Voltage Bandgap Reference in CMOS," Department of Electrical and Computer Engineering, The University of Western Ontario, London ON, Canada, May 2010 (5 pages).

Second Office Action for co-pending CN Appl. No. 201910834152.4 dated Nov. 15, 2021 (11 pages).

* cited by examiner

SUB-BANDGAP COMPENSATED REFERENCE VOLTAGE GENERATION CIRCUIT

RELATED APPLICATION

This application is a continuation of U.S. application for patent Ser. No. 16/558,717, filed on Sep. 3, 2019, which claims priority to U.S. Provisional Application for Patent No. 62/726,564, filed Sep. 4, 2018, the contents of both of which are incorporated by reference to the maximum extent allowable under the law.

TECHNICAL FIELD

This disclosure is related to the field of temperature independent reference voltage generation and, in particular, to a circuit for generating a temperature independent reference voltage that is a fraction of a generated bandgap voltage.

BACKGROUND

Integrated circuit technology offers no reference voltages that are inherently constant regardless of temperature variations. Therefore, a practical way of generating a temperature independent reference voltage is by combining two voltages with precisely complementary temperature behavior. By adding a voltage that increases with temperature (e.g., proportional to absolute temperature) to one that decreases with temperature (e.g., complementary to absolute temperature), provided that the slopes of these voltages are equal in magnitude but opposite in sign, the result will be a voltage that is independent of temperature.

A common circuit used to generate such a temperature independent reference voltage is called a "bandgap voltage generator", which typically has an output voltage around 1.25 V (which is close to the theoretical 1.22 eV bandgap of silicon at 0 K, hence the name "bandgap voltage" generator).

In some instances, however, it may be desirable to generate a temperature independent reference voltage that is but a fraction of the bandgap voltage. This can be referred to as a sub-bandgap reference voltage.

For example, one known sub-bandgap reference voltage generator is described in "A Low-power Low-voltage Bandgap Reference in CMOS", by N. Sun and R. Sobot, published in Electrical and Computer Engineering, 2010, at the 23rd Canadian conference on May 2010. This design generates a sub-bandgap reference voltage using compensated current generation implemented with proportional to absolute temperature (PTAT) and complementary to absolute temperature (CTAT) components in parallel. However, this design may experience issues reaching stability upon device startup, and in some instances, the sub-bandgap reference voltage produced may vary slightly.

Another known sub-bandgap reference voltage generator is described in "A simple CMOS bandgap reference circuit with sub 1V operation", by Joao Navarro and Eder Ishibe, published in Circuits and Systems, IEEE International Symposium, 2011. This design generates a sub-bandgap reference voltage by summing PTAT and CTAT currents using a known voltage difference across a resistor. However, the sub-bandgap reference voltage produced is subject to process variations in the resistor, as well as resistance variations of the resistor over temperature.

A further known sub-bandgap reference voltage generator is described in "A low power bandgap voltage reference for Low-Dropout Regulator", by C. L. Lee, R. M. Sidek, F. Z. Rokhani, and N. Sulaiman, published in Micro and Nanoelectronics 2015 IEEE Regional Symposium, 2015. This design generates the sub-bandgap reference voltage at an intermediate branch of its output stage, between two series connected resistors. Since resistors are subject to process variations and resistance variance over temperature, the sub-bandgap reference voltage produced is subject these variations.

Therefore, further development in the area of sub-bandgap reference voltage generators is still needed.

SUMMARY

Disclosed herein is a circuit, including: a reference current generator circuit. The reference current generator circuit has: a first bipolar junction transistor having an emitter coupled to a first resistor, a collector coupled to ground, and a base; a second bipolar junction transistor having an emitter, a collector coupled to ground, and a base coupled to the base of the first bipolar junction transistor; a first n-channel transistor having a source coupled to the first resistor and a gate; and a second n-channel transistor having a source coupled to the emitter of the second bipolar junction transistor, a drain, and a gate coupled to the drain of the second n-channel transistor and to the gate of the first n-channel transistor. The reference current generator circuit generates a current proportional to absolute temperature. The circuit includes a voltage generator. The voltage generator includes: a third n-channel transistor having a source, and gate coupled to the gates of the first and second n-channel transistors; a fourth n-channel transistor having a drain coupled to the source of the third n-channel transistor, a source coupled to a node, and a gate coupled to the source of the second n-channel transistor; a fifth n-channel transistor having a drain coupled to the node, a source, and a gate coupled to the node; and a sixth n-channel transistor having a drain coupled to the source of the fifth n-channel transistor, a source coupled to ground, and a gate coupled to the drain of the sixth n-channel transistor. A current mirror has an input coupled to receive a replica of the current proportional to absolute temperature, and an output. A differential amplifier has an input coupled to the node and an output generating a temperature insensitive output reference voltage, wherein the differential amplifier is coupled between a supply voltage and the output of the current mirror.

The current mirror may include: a seventh n-channel transistor having a drain coupled to receive the current proportional to absolute temperature, a source coupled to ground, and a gate coupled to the drain of the seventh n-channel transistor; and a twelfth n-channel transistor having a source coupled to ground, and a gate coupled to the gate of the seventh n-channel transistor.

The differential amplifier may include: an eighth n-channel transistor having a source, a drain, and a gate coupled to the drain of the eighth n-channel transistor; a ninth n-channel transistor having a drain coupled to the source of the eighth resistor, a source coupled to a drain of the twelfth n-channel transistor, and a gate coupled to the node; a tenth n-channel transistor having a source, a drain, and a gate coupled to the drain of the tenth n-channel transistor; and an eleventh n-channel transistor having a drain coupled to the source of the tenth n-channel transistor, a source coupled to the drain of the twelfth n-channel transistor, and a gate coupled to the drain of the eleventh n-channel transistor.

A second resistor may be coupled between the source of the eighth n-channel transistor and the drain of the ninth n-channel transistor, and a third resistor may be coupled between the source of the tenth n-channel transistor and the drain of the eleventh n-channel transistor.

The differential amplifier may also include: a fifth p-channel transistor having a source coupled to the supply voltage, a drain coupled to the drain of the eighth n-channel transistor, and a gate coupled to the drain of the fifth p-channel transistor; and a sixth p-channel transistor having a source coupled to the supply voltage, a drain coupled to the drain of the tenth n-channel transistor, and a gate coupled to the gate of the fifth p-channel transistor.

An output stage may include: a seventh p-channel transistor having a source coupled to the supply voltage, a drain, and a gate coupled to the gates of the fifth and sixth p-channel transistors; an eighth p-channel transistor having a source coupled to the supply voltage, a drain, and a gate coupled to the drain of the seventh p-channel transistor; a thirteenth n-channel transistor having a drain coupled to the drain of the seventh p-channel transistor and the gate of the eighth p-channel transistor, a source coupled to the drain of the eighth p-channel transistor, and a gate coupled to the gate of the tenth p-channel transistor; and a fourteenth p-channel transistor having a drain coupled to the source of the thirteenth n-channel transistor and the drain of the eighth p-channel transistor, a source coupled to ground, and a gate coupled to the gates of the seventh and twelfth n-channel transistor.

The voltage generator may include: a first p-channel transistor having a source coupled to the supply voltage, a drain coupled to a drain of the first n-channel transistor, and a gate coupled to the drain of the first p-channel transistor; and a second p-channel transistor having a source coupled to the supply voltage, a drain coupled to the drain of the second n-channel transistor, and a gate coupled to the gate of the first p-channel transistor.

The reference current generator circuit may also include a third p-channel transistor having a source coupled to the supply voltage, a drain coupled to the drain of the third n-channel transistor, and a gate coupled to the drain of the third p-channel transistor.

A fourth p-channel transistor may have a source coupled to the supply voltage, a drain coupled to the input of the current mirror, and a gate coupled to the gates of the first and second p-channel transistors.

Also disclosed herein is a circuit, including: a reference current generator circuit configured to generate a reference current that is proportional to absolute temperature, wherein the reference current generator circuit generates the reference current as a function of a difference between bias voltages of first and second transistors; a voltage generator configured to generate an input voltage from the reference current, wherein the input voltage is complementary to absolute temperature, wherein the voltage generator generates the input voltage by applying the reference current that is proportional to absolute temperature through a plurality of transistors coupled in series between the bias voltage of the second transistor and ground, with the input voltage that is complementary to absolute temperature being generated at a node between given adjacent ones of the plurality of transistors; and a differential amplifier biased by a current derived from the reference current and generating a temperature insensitive output reference voltage from the input voltage and a voltage proportional to absolute temperature.

The plurality of transistors may include a plurality of diode coupled transistors; the plurality of transistors may include a transistor mirroring the reference current to the plurality of diode coupled transistors; and the input voltage is produced at a tap between the transistor and the plurality of diode coupled transistors. The reference current generator circuit generates the reference current as a function of a difference between base to emitter voltages of first and second bipolar junction transistors.

The differential amplifier may include first and second branches in balance and being biased by a current dependent on the reference current to thereby generate the voltage proportional to absolute temperature.

Source follower circuitry may be coupled to the differential amplifier and configured to generate a regulated voltage from the temperature insensitive output reference voltage.

The plurality of transistors may include a number of diode coupled transistors series coupled between a node at which the input voltage is generated and ground, the input voltage being dependent upon the number of diode coupled transistors.

The reference current generator circuit may generate the reference current as a function of a difference between base to emitter voltages of first and second bipolar junction transistor, with an emitter of the first base to emitter voltage being coupled to a first resistor. The differential amplifier may generate the temperature insensitive output reference voltage by passing the current derived from the reference current through a second resistor. The differential amplifier may generate the temperature insensitive output reference voltage as a function of a ratio of a resistance of the first resistor to a resistance of the second resistor.

Also disclosed herein is a circuit, including a reference current generator circuit. The reference current generator circuit includes: a differential pair of transistors coupled to ground; a first current mirror coupled to a supply voltage; a second current mirror coupled between the first current mirror and the differential pair of transistors; and a resistance coupled between a first of the differential pair of transistors and the second current mirror such that a current proportional to absolute temperature is flows between the second current mirror and the differential pair of transistors. The circuit also includes a voltage generator. The voltage generate includes: a mirror transistor coupled in a current mirror arrangement with the second current mirror of the reference current generator; a diode coupled transistor coupled between the mirror transistor and the supply voltage; a pair of diode coupled transistors coupled between a node and ground; and an intermediate transistor coupled between the mirror transistor and the pair of diode coupled transistors such that a replica of the current proportional to absolute temperature flows through the pair of diode coupled transistors to thereby generate an input voltage that is complementary to absolute temperature at the node. A tail current mirror has an input coupled to receive another replica of the current proportional to absolute temperature and an output drawing a tail current from a tail node. The circuit also includes a differential amplifier with: a differential pair of input transistors coupled to the tail node such that the tail current is drawn from the differential pair of input transistors by the tail current mirror; a source current mirror coupled to the supply voltage; and an additional pair of diode coupled transistors coupled between the source current mirror and the differential pair of input transistors, wherein the additional pair of diode coupled transistors are coupled to the differential pair of input transistors through a pair of resistances such that a temperature insensitive output reference voltage is generated based upon the input voltage and a voltage proportional to absolute temperature.

The intermediate transistor may have a first conduction terminal coupled to receive the replica of the current proportional to absolute temperature, a second conduction terminal coupled to the pair of diode coupled transistors, and a control terminal coupled to a second of the differential pair of transistors of the reference current generators.

An additional mirror transistor may be coupled in a current mirror arrangement with the first current mirror of the reference current generator and generating the replica of the current proportional to absolute temperature.

The differential pair of input transistors may include: a first transistor having a first conduction terminal coupled to a first of the additional pair of diode coupled transistors through a first of the pair of resistances, a second conduction terminal coupled to the tail node, and a control terminal coupled to the node to receive the input voltage that is complementary to absolute temperature; and a second transistor that is diode coupled between a second of the pair of resistances and the tail node such that that a further replica of the current proportional to absolute temperature flows through the second of the pair of resistances to thereby generate the voltage proportional to absolute temperature across the second of the pair of resistances.

The second of the pair of resistances may be coupled between a second of the additional pair of diode coupled transistors and a first conduction terminal of the second transistor of the differential pair of input transistors. The second transistor of the differential pair of input transistors may have a second conduction terminal coupled to the tail current node and a control terminal coupled to the first conduction terminal of the second transistor of the differential pair of input transistors. The temperature insensitive output reference voltage may be generated as being across a series combination of the second of the pair of resistances, the second transistor of the differential pair of input transistors, and the tail current mirror.

An output stage may be coupled between the supply voltage and ground, and generate a regulated voltage based upon the temperature insensitive output reference voltage.

The output stage may include: a first output stage transistor having a first conduction terminal coupled to the supply voltage, a second conduction terminal, and a control terminal coupled to control terminals of transistors of the source current mirror; a second output stage transistor having a first conduction terminal coupled to the second conduction terminal of the first output stage transistor, a second conduction terminal, and a control terminal coupled to a conduction terminal of one of the additional pair of diode coupled transistors; a third output stage transistor having a first conduction terminal coupled to the supply voltage, a second conduction terminal coupled to the second conduction terminal of the second output stage transistor, and a control terminal coupled to the first conduction terminal of the second output stage transistor, wherein the regulated voltage is generated at the second conduction terminal of the third output stage transistor; and a fourth output stage transistor having a first conduction terminal coupled to the second conduction terminal of the second output stage transistor, a second conduction terminal coupled to ground, and a control terminal coupled to control terminals of the tail current mirror.

DETAILED DESCRIPTION

The following disclosure enables a person skilled in the art to make and use the subject matter disclosed herein. The general principles described herein may be applied to embodiments and applications other than those detailed above without departing from the spirit and scope of this disclosure. This disclosure is not intended to be limited to the embodiments shown, but is to be accorded the widest scope consistent with the principles and features disclosed or suggested herein.

Figure 1:
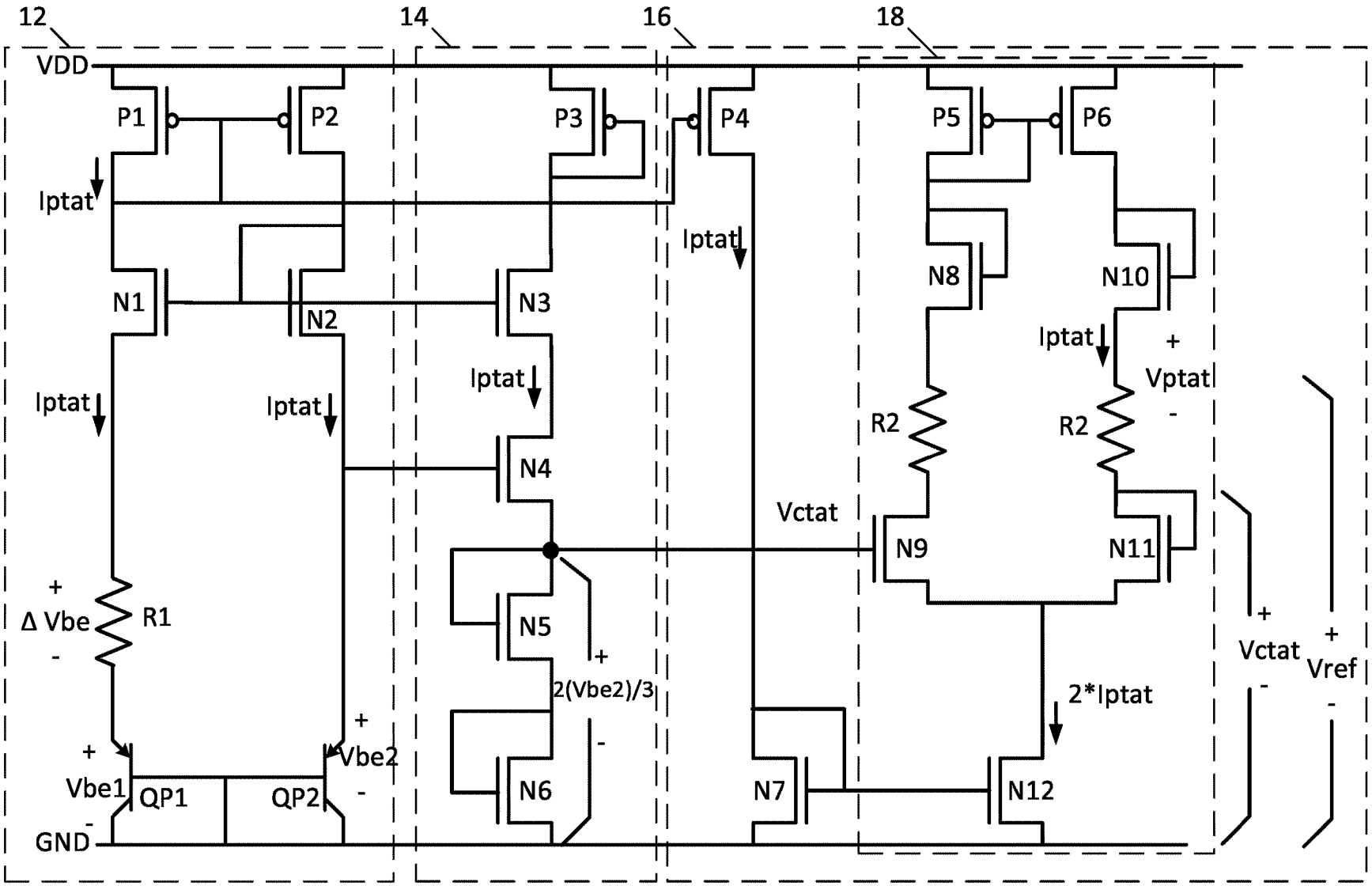
FIG. 1 is a detailed schematic diagram of a sub-bandgap reference voltage generator in accordance with this disclosure.

A sub-bandgap reference voltage (Vref) generator is now described with reference to FIG. 1. For ease of explanation and understanding, the Vref generator will be described in terms of three constituent circuit blocks 12, 14, and 16. Block 12 is responsible for generation of a current proportional to absolute temperature Iptat, while block 14 is responsible for generation of a voltage complementary to absolute temperature Vctat, which in turn is used to control a differential amplifier 18 within block 16 to generate Vref.

In detail, block 12 is a constant transconductance circuit, with PMOS transistors P1 and P2 arranged as a current mirror, with the sources of PMOS transistors P1 and P2 being coupled to a supply node VDD, and the gates of PMOS transistors P1 and P2 being coupled to the drain of PMOS transistor P1. NMOS transistors N1 and N2 are also arranged as a current mirror, with the drain of NMOS transistor N1 coupled to the drain of PMOS transistor P1, the drain of NMOS transistor N2 coupled to the drain of PMOS transistor P2, and the gates of NMOS transistors N1 and N2 coupled to the drain of NMOS transistor N2. The source of NMOS transistor N1 is coupled to the emitter of diode coupled PNP transistor QP1 through resistor R1, while the source of NMOS transistor N2 is directly coupled to the emitter of diode coupled PNP transistor QP2.

Once operating in a stable state, the current mirror formed from PMOS transistors P1 and P2 enforces equality in the drain currents of NMOS transistors N1 and N2, and therefore equality in the gate to source voltages Vgs of NMOS transistors N1 and N2. This results in the base to emitter voltage Vbe2 of PNP transistor QP2 being applied at the source of NMOS transistor N1. Since resistor R1 is between the voltages Vbe2 and Vbe1 (the base to emitter voltage of PNP transistor QP1), the voltage across resistor R1 is Vbe2−Vbe1, which can be referred to as ΔVbe. The resulting current Iptat applied through resistor R1 is proportional to absolute temperature and flows into PNP transistor QP2 due to the current mirror formed from NMOS transistors N1 and N2. Iptat can be calculated as:

$$Iptat=\Delta Vbe/R1$$

Block 14 is comprised of a single branch, and includes diode coupled PMOS transistor P3 having its source coupled to the supply node Vdd and its gate coupled to its drain. NMOS transistor N3 has its drain coupled to the drain of PMOS transistor P3, and its gate coupled to the gates of NMOS transistors N1 and N2 in a current mirroring relationship. NMOS transistor N4 has its gate coupled to the source of NMOS transistor N2 and is thus biased by the voltage Vbe2. The drain of NMOS transistor N4 is coupled to the source of NMOS transistor N3.

NMOS transistors N5 and N6 are diode connected. In particular, NMOS transistor N5 has its drain coupled to the source of NMOS transistor N4 and its gate coupled to its drain. NMOS transistor N6 has its drain coupled to the source of NMOS transistor N5, its gate coupled to its drain, and its source coupled to ground.

In operation, the source of NMOS transistor N3 is approximately equal to the source of NMOS transistor N2, which results in the drain voltage of NMOS transistor N4 being approximately at Vbe2, which it is noted is also the gate voltage of NMOS transistor N4. As the NMOS transistors N4, N5 and N6 all are carrying same current, the gate to source voltages (Vgs) of NMOS transistors N4, N5, and N6 will therefore be the same Since the voltage from the gate of NMOS transistor N4 to the source of NMOS transistor N6 (which is at ground) is Vbe2, and since the Vgs for each of the NMOS transistors N4, N5, and N6 is the same, the voltage from the drain of NMOS transistor N5 to ground will be 2Vbe2/3, which is a voltage complementary to absolute temperature, and can be referred to as Vctat. The purpose of using block 14 to produce Vctat, as opposed to a resistive divider, is to avoid loading the components of block 12.

Block 16 includes PMOS transistor P4 having its source coupled to the supply node VDD and its gate coupled to the gates of PMOS transistors P1 and P2 in a current mirroring relationships. Block 16 also includes a current mirror formed from NMOS transistors N7 and N12. The drain of NMOS transistor N7 is coupled to its gate and to the drain of PMOS transistor P4, and the source of NMOS transistor N7 is coupled to ground.

Block 16 also includes a differential amplifier 18 in a unity gain configuration. The differential amplifier 18 is comprised of PMOS load transistors P5 and P6, diode coupled NMOS transistors N8 and N10, two resistors R2, NMOS differential input transistors N9 and N11, and a tail current source formed from NMOS transistor N12.

In greater detail, NMOS transistor N12 has its gate coupled to the gate and drain of NMOS transistor N7, and its source coupled to ground. PMOS transistors P5 and P6 have their sources coupled to the supply node VDD and their gates coupled to one another. The drain of PMOS transistor P5 is coupled to its gate. NMOS transistor N8 has its drain coupled to the drain of PMOS transistor P5 and has its gate coupled to its drain. A resistor R2 is coupled between the source of NMOS transistor N8 and the drain of NMOS transistor N9. NMOS transistor N9 has its gate biased by Vctat and its source coupled to the drain of NMOS transistor N12. NMOS transistor N10 has its drain coupled to the drain of PMOS transistor P6 and its gate coupled to its drain. Another resistor R2 (also denoted R2 to show that both of these resistors have the same resistance) is coupled between the source of NMOS transistor N10 and the drain of NMOS transistor N11. NMOS transistor N11 has its gate coupled to its drain and its source coupled to the drain of NMOS transistor N12.

In operation, since PMOS transistor P4 is in a current mirroring relationship with PMOS transistors P1 and P2, it emits the current Iptat from its drain. The current mirror formed from NMOS transistors N7 and N12 receives the current Iptat from PMOS transistor P4 as input, and due to a 2:1 mirroring ratio, draws current 2*Iptat from the tail of the differential amplifier 18. Since the left and right branches of the differential amplifier 18 are balanced, this means that the current Iptat flows through each branch. Therefore, Iptat is applied through both resistors R2, generating a voltage proportional to absolute temperature Vptat. Vptat can be calculated as:

$$Vptat=Iptat*R2$$

Since the differential amplifier 18 is in a unity gain configuration with its output (at the drain of NMOS transistor N11) coupled to its inverting input (the gate of NMOS transistor N11), the voltage Vctat is produced at the drain of NMOS transistor N11. By summing the voltage Vctat with the voltage Vptat, the temperature dependence is canceled out, and the sub-bandgap voltage Vref is produced. Mathematically, it can be noted that since Vptat=Iptat*R2 and since Iptat=ΔVbe/R1, through substitution, Vptat can be represented as (ΔVbe/R1)*R2, and thus:

$$Vptat=(R2/R1)*\Delta Vbe$$

Note that since Vctat=2Vbe2/3, Vref can thus be calculated as:

$$Vref=2Vbe2/3+R2/R1\Delta Vbe$$

It is noted that diode coupled NMOS transistors N8 and N10 serve to provide adequate headroom between Vref and VDD such that the current mirror formed from PMOS transistors P5 and P6 operates properly.

Figure 2:
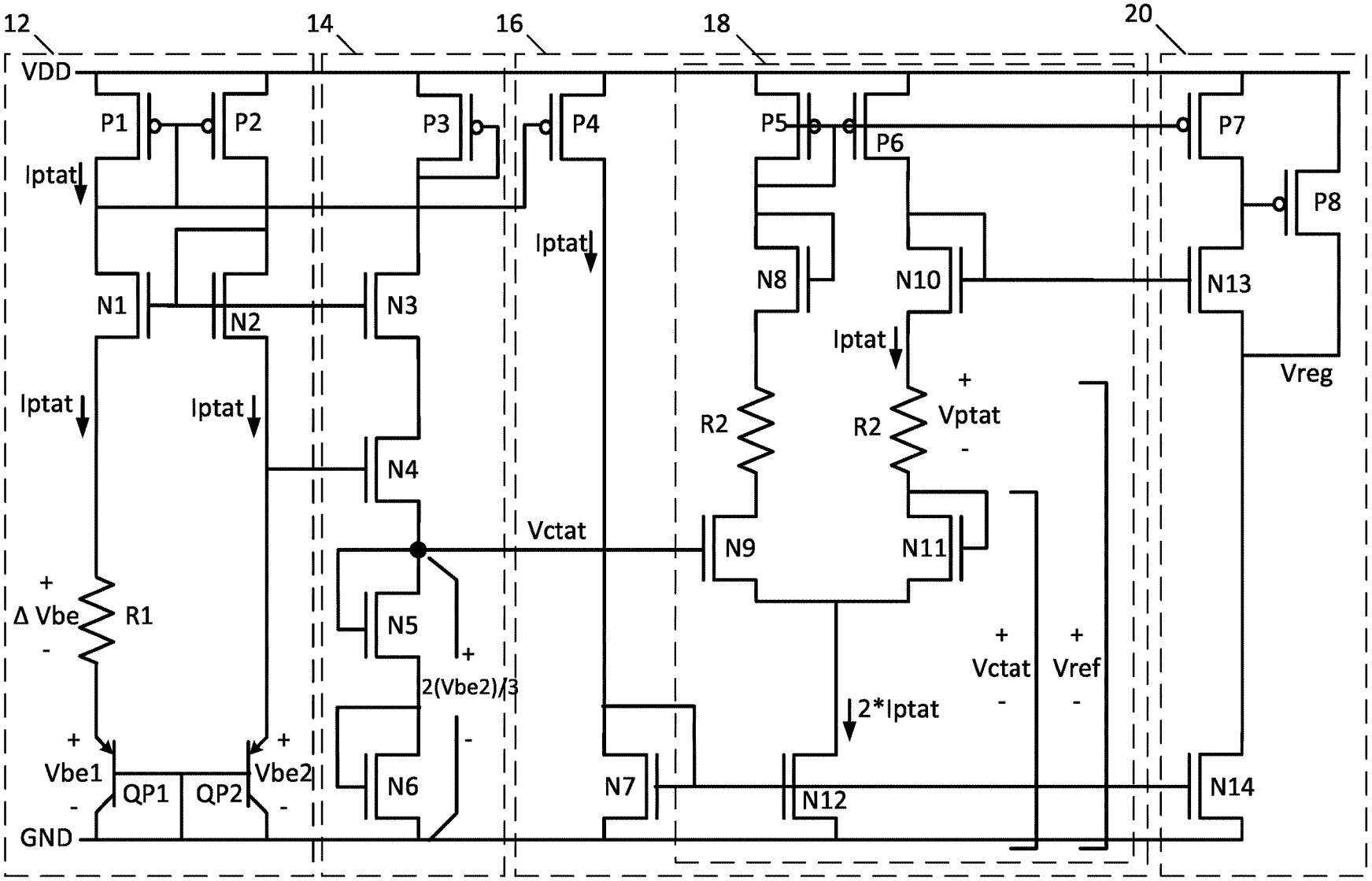
FIG. 2 is a detailed schematic diagram of an additional embodiment of a sub-bandgap reference voltage generator combined with a super source follower to create a voltage regulator, in accordance with this disclosure.

With additional reference to FIG. 2, source follower circuitry 20 can be used to generate a regulator voltage Vreg from the reference voltage Vref. The blocks 12, 14, 16, and 18 shown in FIG. 2 are the same as in FIG. 1 and need no further description, so the following will focus on the source follower circuitry 20.

The source follower circuitry 20 includes PMOS transistor P7 having its source coupled to the supply node VDD, and its gate coupled to the gates of PMOS transistors P5 and P6 in a current mirror relationship. PMOS transistor P8 has its source coupled to the supply node VDD and its gate coupled to the drain of PMOS transistor P7. NMOS transistor N13 has its drain coupled to the gate of PMOS transistor P8, forming a super source follower. NMOS transistor N14 has its drain coupled to the source of NMOS transistor N13, its source coupled to ground, and its gate coupled to the gates of NMOS transistors N7 and N12 in a current mirroring relationship. This produces a regulated voltage Vreg at the source of NMOS transistor N13 and drain of PMOS transistor P8. This regulated voltage can be calculated as:

$$Vreg=Vref+(VgsN10-VgsN13)$$

Advantages provided by the Vref generator include a low voltage head-room requirement, and easy scaling of Vref. Vref can be scaled by changing the number of diode coupled NMOS transistors in block 14, for example, as the use of two as shown sets the ratio of ⅔ as described. Other numbers will produce different ratios. Vref can also be scaled by changing the ratio of R2 to R1. Moreover, the components of this Vref generator can be low current components.

While the disclosure has been described with respect to a limited number of embodiments, those skilled in the art, having benefit of this disclosure, will appreciate that other embodiments can be envisioned that do not depart from the scope of the disclosure as disclosed herein. Accordingly, the scope of the disclosure shall be limited only by the attached claims.

The invention claimed is:

1. A circuit, comprising:

a reference current generator circuit comprising:

a first bipolar junction transistor having an emitter coupled to a first resistor, a collector coupled to ground, and a base;

a second bipolar junction transistor having an emitter, a collector coupled to ground, and a base coupled to the base of the first bipolar junction transistor;

a first n-channel transistor having a source coupled to the first resistor and a gate; and a second n-channel transistor having a source coupled to the emitter of the second bipolar junction transistor, a drain, and a gate coupled to the drain of the second n-channel transistor and to the gate of the first n-channel transistor;

wherein the reference current generator circuit generates a current proportional to absolute temperature;

a voltage generator comprising:

a third n-channel transistor having a source, and gate coupled to the gates of the first and second n-channel transistors;

a fourth n-channel transistor having a drain coupled to the source of the third n-channel transistor, a source coupled to a node, and a gate coupled to the source of the second n-channel transistor;

a fifth n-channel transistor having a drain coupled to the node, a source, and a gate coupled to the node; and a sixth n-channel transistor having a drain coupled to the source of the fifth n-channel transistor, a source coupled to ground, and a gate coupled to the drain of the sixth n-channel transistor;

a current mirror having an input coupled to receive a replica of the current proportional to absolute temperature, and an output; and a differential amplifier having an input coupled to the node and an output generating a temperature insensitive output reference voltage, wherein the differential amplifier is coupled between a supply voltage and the output of the current mirror.

2. The circuit of claim 1, wherein the current mirror comprises:

a seventh n-channel transistor having a drain coupled to receive the current proportional to absolute temperature, a source coupled to ground, and a gate coupled to the drain of the seventh n-channel transistor; and a twelfth n-channel transistor having a source coupled to ground, and a gate coupled to the gate of the seventh n-channel transistor.

3. The circuit of claim 2, wherein the differential amplifier comprises:

an eighth n-channel transistor having a source, a drain, and a gate coupled to the drain of the eighth n-channel transistor;

a ninth n-channel transistor having a drain coupled to the source of the eighth n-channel transistor, a source coupled to a drain of the twelfth n-channel transistor, and a gate coupled to the node;

a tenth n-channel transistor having a source, a drain, and a gate coupled to the drain of the tenth n-channel transistor; and an eleventh n-channel transistor having a drain coupled to the source of the tenth n-channel transistor, a source coupled to the drain of the twelfth n-channel transistor, and a gate coupled to the drain of the eleventh n-channel transistor.

4. The circuit of claim 3, further comprising a second resistor coupled between the source of the eighth n-channel transistor and the drain of the ninth n-channel transistor, and a third resistor coupled between the source of the tenth n-channel transistor and the drain of the eleventh n-channel transistor.

5. The circuit of claim 3, wherein the differential amplifier further comprises:

a fifth p-channel transistor having a source coupled to the supply voltage, a drain coupled to the drain of the eighth n-channel transistor, and a gate coupled to the drain of the fifth p-channel transistor; and a sixth p-channel transistor having a source coupled to the supply voltage, a drain coupled to the drain of the tenth n-channel transistor, and a gate coupled to the gate of the fifth p-channel transistor.

6. The circuit of claim 5, further comprising an output stage having:

a seventh p-channel transistor having a source coupled to the supply voltage, a drain, and a gate coupled to the gates of the fifth and sixth p-channel transistors;

an eighth p-channel transistor having a source coupled to the supply voltage, a drain, and a gate coupled to the drain of the seventh p-channel transistor;

a thirteenth n-channel transistor having a drain coupled to the drain of the seventh p-channel transistor and the gate of the eighth p-channel transistor, a source coupled to the drain of the eighth p-channel transistor, and a gate coupled to the gate of the tenth n-channel transistor; and a fourteenth p-channel transistor having a drain coupled to the source of the thirteenth n-channel transistor and the drain of the eighth p-channel transistor, a source coupled to ground, and a gate coupled to the gates of the seventh and twelfth n-channel transistor.

7. The circuit of claim 1, wherein the voltage generator further comprises:

a first p-channel transistor having a source coupled to the supply voltage, a drain coupled to a drain of the first n-channel transistor, and a gate coupled to the drain of the first p-channel transistor; and a second p-channel transistor having a source coupled to the supply voltage, a drain coupled to the drain of the second n-channel transistor, and a gate coupled to the gate of the first p-channel transistor.

8. The circuit of claim 7, wherein the reference current generator circuit further comprises a third p-channel transistor having a source coupled to the supply voltage, a drain coupled to the drain of the third n-channel transistor, and a gate coupled to the drain of the third p-channel transistor.

9. The circuit of claim 8, further comprising a fourth p-channel transistor having a source coupled to the supply voltage, a drain coupled to the input of the current mirror, and a gate coupled to the gates of the first and second p-channel transistors.

10. A circuit, comprising:

a reference current generator circuit configured to generate a reference current that is proportional to absolute temperature, wherein the reference current generator circuit generates the reference current as a function of a difference between bias voltages of first and second transistors;

a voltage generator configured to generate an input voltage from the reference current, wherein the input voltage is complementary to absolute temperature, wherein the voltage generator generates the input voltage by applying the reference current that is proportional to absolute temperature through a plurality of transistors coupled in series between the bias voltage of the second transistor and ground, with the input voltage that is complementary to absolute temperature being generated at a node between given adjacent ones of the plurality of transistors; and a differential amplifier biased by a current derived from the reference current and generating a temperature insensitive output reference voltage from the input voltage and a voltage proportional to absolute temperature.

11. The circuit of claim 10, wherein the plurality of transistors comprises a plurality of diode coupled transistors; wherein the plurality of transistors includes a transistor mirroring the reference current to the plurality of diode coupled transistors; and wherein the input voltage is produced at a tap between the transistor mirroring the reference current and the plurality of diode coupled transistors.

12. The circuit of claim 10, wherein the reference current generator circuit generates the reference current as a function of a difference between base to emitter voltages of first and second bipolar junction transistors.

13. The circuit of claim 10, wherein the differential amplifier includes first and second branches in balance and being biased by a current dependent on the reference current to thereby generate the voltage proportional to absolute temperature.

14. The circuit of claim 10, further comprising source follower circuitry coupled to the differential amplifier and configured to generate a regulated voltage from the temperature insensitive output reference voltage.

15. The circuit of claim 10, wherein the plurality of transistors comprise a number of diode coupled transistors series coupled between a node at which the input voltage is generated and ground, wherein the input voltage is dependent upon the number of diode coupled transistors.

16. The circuit of claim 10, wherein the reference current generator circuit generates the reference current as a function of a difference between base to emitter voltages of first and second bipolar junction transistor, with an emitter of the first base to emitter voltage being coupled to a first resistor; wherein the differential amplifier generates the temperature insensitive output reference voltage by passing the current derived from the reference current through a second resistor; and wherein the differential amplifier generates the temperature insensitive output reference voltage as a function of a ratio of a resistance of the first resistor to a resistance of the second resistor.

17. A circuit, comprising:

a reference current generator circuit comprising:

a differential pair of transistors coupled to ground;

a first current mirror coupled to a supply voltage;

a second current mirror coupled between the first current mirror and the differential pair of transistors; and a resistance coupled between a first of the differential pair of transistors and the second current mirror such that a current proportional to absolute temperature is flows between the second current mirror and the differential pair of transistors;

a voltage generator comprising:

a mirror transistor coupled in a current mirror arrangement with the second current mirror of the reference current generator circuit;

a diode coupled transistor coupled between the mirror transistor and the supply voltage;

a pair of diode coupled transistors coupled between a node and ground; and an intermediate transistor coupled between the mirror transistor and the pair of diode coupled transistors such that a replica of the current proportional to absolute temperature flows through the pair of diode coupled transistors to thereby generate an input voltage that is complementary to absolute temperature at the node;

a tail current mirror having an input coupled to receive another replica of the current proportional to absolute temperature and an output drawing a tail current from a tail node; and a differential amplifier comprising:

a differential pair of input transistors coupled to the tail node such that the tail current is drawn from the differential pair of input transistors by the tail current mirror;

a source current mirror coupled to the supply voltage; and an additional pair of diode coupled transistors coupled between the source current mirror and the differential pair of input transistors, wherein the additional pair of diode coupled transistors are coupled to the differential pair of input transistors through a pair of resistances such that a temperature insensitive output reference voltage is generated based upon the input voltage and a voltage proportional to absolute temperature.

18. The circuit of claim 17, wherein the intermediate transistor has a first conduction terminal coupled to receive the replica of the current proportional to absolute temperature, a second conduction terminal coupled to the pair of diode coupled transistors, and a control terminal coupled to a second of the differential pair of transistors of the reference current generator circuit.

19. The circuit of claim 17, further comprising an additional mirror transistor coupled in a current mirror arrangement with the first current mirror of the reference current generator and generating the replica of the current proportional to absolute temperature.

20. The circuit of claim 17, wherein the differential pair of input transistors comprises:

a first transistor having a first conduction terminal coupled to a first of the additional pair of diode coupled transistors through a first of the pair of resistances, a second conduction terminal coupled to the tail node, and a control terminal coupled to the node to receive the input voltage that is complementary to absolute temperature; and a second transistor that is diode coupled between a second of the pair of resistances and the tail node such that that a further replica of the current proportional to absolute temperature flows through the second of the pair of resistances to thereby generate the voltage proportional to absolute temperature across the second of the pair of resistances.

21. The circuit of claim 20, wherein:

the second of the pair of resistances is coupled between a second of the additional pair of diode coupled transistors and a first conduction terminal of the second transistor of the differential pair of input transistors;

the second transistor of the differential pair of input transistors has a second conduction terminal coupled to the tail node and a control terminal coupled to the first conduction terminal of the second transistor of the differential pair of input transistors; and the temperature insensitive output reference voltage is generated as being across a series combination of the second of the pair of resistances, the second transistor of the differential pair of input transistors, and the tail current mirror.

22. The circuit of claim 20, further comprising an output stage coupled between the supply voltage and ground, and generating a regulated voltage based upon the temperature insensitive output reference voltage.

23. The circuit of claim 22, wherein the output stage comprises:

a first output stage transistor having a first conduction terminal coupled to the supply voltage, a second conduction terminal, and a control terminal coupled to control terminals of transistors of the source current mirror;

a second output stage transistor having a first conduction terminal coupled to the second conduction terminal of the first output stage transistor, a second conduction terminal, and a control terminal coupled to a conduction terminal of one of the additional pair of diode coupled transistors;

a third output stage transistor having a first conduction terminal coupled to the supply voltage, a second conduction terminal coupled to the second conduction terminal of the second output stage transistor, and a control terminal coupled to the first conduction terminal of the second output stage transistor, wherein the regulated voltage is generated at the second conduction terminal of the third output stage transistor; and a fourth output stage transistor having a first conduction terminal coupled to the second conduction terminal of the second output stage transistor, a second conduction terminal coupled to ground, and a control terminal coupled to control terminals of the tail current mirror.

* * * * *